United States Patent [19]

Astner et al.

[11] Patent Number: 4,706,943

[45] Date of Patent: Nov. 17, 1987

[54] CONNECTION DEVICE FOR PLASMA GENERATORS

[75] Inventors: Gunnar Astner; Sten-Ove Sjöström, both of Hofors, Sweden

[73] Assignee: SKF Steel Engineering AB, Hofors, Sweden

[21] Appl. No.: 797,077

[22] Filed: Nov. 12, 1985

[30] Foreign Application Priority Data

Dec. 3, 1984 [SE] Sweden ..... 8406089

[51] Int. Cl.[4] ..... F27D 11/08

[52] U.S. Cl. ..... 266/265; 373/18

[58] Field of Search ..... 266/265; 373/18, 22, 373/24

[56] References Cited

U.S. PATENT DOCUMENTS 4,423,858 1/1984 Ostlund ..... 266/265

FOREIGN PATENT DOCUMENTS 2212396 9/1973 Fed. Rep. of Germany .

1236771 6/1960 France .

*Primary Examiner*—Melvyn J. Andrews

*Attorney, Agent, or Firm*—Armstrong, Nikaido, Marmelstein & Kubovcik

[57] ABSTRACT

The invention relates to a device for facilitating the connection of burners, especially plasma generators, to reactor tuyeres in vertical furnaces for metal oxide reduction with simultaneous sealing of the vertical furnace, composed of a sealing ring (13) with a unit for the supply of a protective gas (10, 17, 18, 19). In this case the sealing ring (13) is constructed radially movable in a seat (12).

8 Claims, 2 Drawing Figures

CONNECTION DEVICE FOR PLASMA GENERATORS

The present invention relates to a device for easier connection of burners to reactor tuyeres in vertical furnaces for metal oxide reduction with simultaneous sealing of the reactor by means of a sealing ring having a supply unit for protective gases.

Devices for the exchange of burners in vertical furnace reactors during continuous operation are already known. One such case involves the use of a valve placed in the reactor wall near a reactor tuyere whereby the valve totally seals the reactor from the surrounding atmosphere when the plasma generator itself is removed. On insertion of the plasma generator, the valve can only be opened when the plasma generator is in its sealed position, i.e. with the nose being partly inserted in the connector to the reactor tuyere.

One problem with the presently known technique is that during the time elapsing between the opening of the valve and the changing of the plasma generator from the sealed position to the operating position, leakage occurs in the column between the wall of the reactor tuyeres and the nose of the plasma generator. This leakage can be minimized by shaping the opening of the connector to the reactor tuyeres to form a tight fit as regards the circumference of the nose of the plasma generator. This certainly reduces such leakage somewhat but leads instead to considerably more difficult insertion of the plasma generator. Thus, expensive and bulky devices for accurate adjustment of the plasma generator before its insertion must be constructed.

The object of the present invention is to obtain a sealing device which almost totally eliminates leakage during the insertion of burners in reactor tuyeres in vertical furnaces during operation and especially on insertion of a plasma generator from the sealing position, in which it seals the reactor from the surrounding atmosphere, until the plasma generator is moved to the operating position, when the plasma generator seals against the already present sealing surface of the reactor, and which device also should facilitate the insertion of the plasma generator.

This is attained by means of a device according to the present invention which is characterized by the construction of a radially movable sealing ring in a seat. In this way at least some variations in the plasma generator's positional adjustments can be absorbed due to the sealing ring being movable in a radial direction.

According to a preferred embodiment of the invention, the end of the sealing ring, from the direction of the vertical furnace, is conically widened. Due to this conical widening of the intake end, the insertion of the plasma generator is further simplified and if the plasma generator is somewhat obliquely placed, the nose will be directed into the sealing ring which is able to move radially, while at the same time, supply of the protective gas ensures that the furnace is effectively sealed against the surrounding atmosphere.

Figure 1:
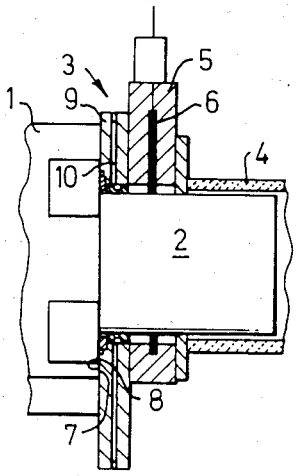
Figure 2:
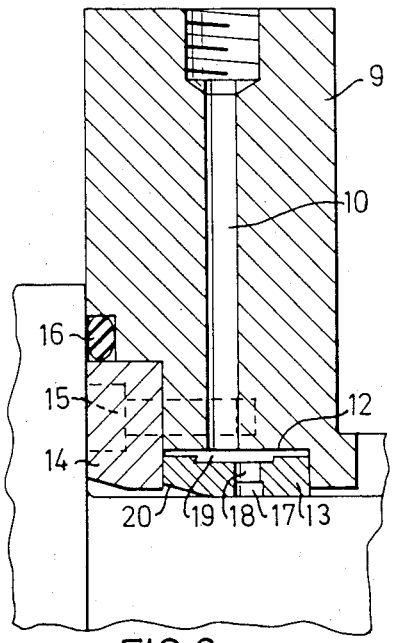

Further characteristics and advantages of the invention are described in more detail with reference to the enclosed drawing, in which FIG. 1 shows a partly sectional view of the connecting part of the reactor tuyere, with a plasma generator inserted in the operating position; and FIG. 2 shows an enlarged section of the device in FIG. 1.

A plasma generator is shown in FIG. 1 with its nose 2 inserted at the operating position into the connecting section 3 to a reactor tuyere 4, which is situated in a vertical furnace wall which is not shown in detail. The plasma generator is moved to its sealing position where valve disc 6 of the valve 5 opens, after which the generator is inserted in the operating postition, as shown in the figure. Hereby, an outer surface 7 in the plasma generator seals against a sealing surface 8 on the outer wall of the connecting unit 3. Preferably, some form of sealing device is also constructed between the two surfaces.

FIG. 2 shows an enlarged section of the device according to FIG. 1, by which it can be seen that the device consists of a flange 9 with channel 10 for the supply of some form of protective gas. In flange 9 a holder 12 is placed for an inner sealing ring 13. The sealing ring 13 is kept in place by a lock ring 14 which in turn is secured by means of bolts which are shown by dotted lines at 15. Exchange of the sealing ring 13 is hereby simplified. Furthermore, an O-ring seal 16 is shown forming a seal between the plasma generator and the sealing surface.

The sealing ring 13 contains an inner groove 17 with openings 18 which communicate with the ring chamber 19 within the sealing ring 13, to which protective gas is supplied by the abovementioned channel 10.

The sealing ring 13 also has a widened intake end 20 which facilitates insertion of the nose of the plasma generator.

The sealing ring 13 is also constructed to be radially movable in relation to the seat 12, by the outer diameter of the sealing ring being made smaller in relation to the diameter of the seat.

According to one embodiment of the invention, the sealing ring 13 can be constructed of a somewhat resilient material with a low friction coefficient, e.g. teflon, or red metal. This facilitates and protects the plasma generator during its insertion, makes the movement of the sealing ring easier in a radial direction and also decreases wear of the seat.

Examples of suitable protective gases in this connection are nitrogen and argon.

We claim:

1. A device for facilitating the connection of a burner to a reaction tuyere in a furnace with simultaneous sealing of the furnace by means of a protective gas during connection, comprising:
   - a circular flange capable of being mounted in a wall of said furnace and having an inner and outer circumference;
   - a seat provided on the inner circumference of said flange;
   - a sealing ring mounted in said seat and being radially movable in said seat to form an annular chamber on the inner circumference of said flange, said sealing ring having an inner and outer circumference and a groove provided on the inner circumference thereof which communicates with said annular chamber; and
   - a channel provided in said flange and communicating with said annular chamber for supplying said protective gas thereto.

2. A device according to claim 1, wherein the inner circumference of said sealing ring forms a frusto-conically-shaped surface.

3. A device according to claim 1, wherein the sealing ring is made of red metal.

4. A device according to claim 1, wherein the sealing ring is made of polytetrafluoroethylene.

5. A device for facilitating the connection of a burner to a reactor tuyere in a furnace with simultaneous sealing of the furnace by means of a protective gas during connection, comprising:

a circular flange capable of being mounted in a wall of said furnace and having an inner and outer circumference and having an outwardly facing sealing surface capable of cooperating with a sealing surface provided on said burner, a seat provided on the inner circumference of said flange, a sealing ring mounted in said seat and being radially movable in said seat to form an annular chamber on the inner circumference of said flange, said sealing ring having an inner and outer circumference and a groove provided on the inner surface thereof which communicates with said annular chamber, a channel provided in said flange and communicating with said annular chamber for supplying said protective gas thereto, and a valve with a valve disc arranged between said flange and said furnace wall and arranged to be opened when the burner is inserted into said sealing ring.

6. A device according to claim 5, wherein the inner circumference of said sealing ring forms a frusto-conically-shaped surface.

7. A device according to claim 5, wherein the sealing ring is made of red metal.

8. A device according to claim 5, wherein the sealing ring is made of polytetrafluoroethylene.

* * * * *